United States Patent [19]

VanDril

[11] 4,413,811

[45] Nov. 8, 1983

[54] WATER-COOLED, LININGLESS CUPOLA

[75] Inventor: William A. VanDril, Frankfort, Ill.

[73] Assignee: Whiting Corporation, Harvey, Ill.

[21] Appl. No.: 389,422

[22] Filed: Jun. 17, 1982

[51] Int. Cl.[3] ..... F27B 1/24

[52] U.S. Cl. ..... 266/190; 266/241; 266/900

[58] Field of Search ..... 266/900, 192, 241, 286, 266/190, 192

[56] References Cited

U.S. PATENT DOCUMENTS 3,892,396 7/1975 Monaghan ..... 266/286
4,009,870 3/1977 Obenchain ..... 266/192

FOREIGN PATENT DOCUMENTS 724740 2/1955 United Kingdom ..... 266/192

*Primary Examiner*—M. J. Andrews
*Attorney, Agent, or Firm*—Lockwood, Dewey, Alex & Cummings

[57] ABSTRACT

An improved water-cooled, liningless cupola wherein the lower portion of the water-cooled body section, including the high heat area above the tuyeres, tapers inwardly toward the bottom with the taper terminating a short distance above the tuyeres and with the remainder of the bottom end of the body section, which includes the tuyere area, being either cylindrical or outwardly tapered. Preferably, the cylindrical or outwardly tapered bottom end portion plus an upper adjacent section of the inwardly tapered lower portion are provided with a multiplicity of interiorly projecting studs which serve to anchor the initial refractory lining and, thereafter, skull after it is formed.

5 Claims, 3 Drawing Figures

WATER-COOLED, LININGLESS CUPOLA

This invention relates to certain improvements in a well-known type of cupola namely, water-cooled, liningless cupolas.

Conventionally, the body section of a water-cooled, liningless cupola is outwardly tapered in the downward direction so that the cooling water sprayed, or otherwise distributed, at the upper end of the body section will adhere to the outer surface of the metal sidewall as it flows downwardly in the form of a film-like sheath.

Water-cooled, liningless cupolas are also known wherein the lower portion of the body section, including the high heat area above the tuyeres, has a reverse taper. That is, this lower portion tapers inwardly in the downward direction. It was found that by collecting the cooling water where the upper end of the reverse taper lower portion joins the lower end of the outwardly tapered upper portion of the water-cooled body section, and then re-distributing the collected water, it would still adhere as a film to the outer surface of the reverse taper section and provide the necessary cooling action.

The water-cooled, liningless cupolas having reverse taper portions have met with significant success in the foundry industry since they offer the following known advantages:

1. Heat loss through the shell and tuyeres is substantially reduced by promoting skull formation on the inside of the reverse taper portion since the inward sloping configuration provides support for the skull to adhere to.

2. Centralized melting and more efficient combustion of the coke are obtained by increasing the tendency of the coke to "cave-in" toward the center in the reverse taper zone as the volume decreases due to coke consumption below and material melting above.

3. Longer shell and tuyere life are realized since the skull formation in the reverse taper zone reduces the temperature of the shell material and offers some protection to the tuyeres.

While the foregoing and other advantages have been welcomed, water-cooled, liningless cupolas wherein the body sections have a lower reverse taper have exhibited one particular problem. The problem resides in occasional breakouts through the shell in-between the tuyeres due to molten metal dripping down onto the inside surface of the reverse taper portion of the shell. Even though the aboveknown advantages substantially out-weigh the disadvantage due to this particular problem and the problem has been tolerated, nevertheless, a solution thereto is known to be desirable. The present invention provides a very satisfactory solution.

According to the present invention, it was discovered that if, in a water-cooled, liningless cupola having the lower portion of the body section including the high heat area above the tuyeres provided with a reverse or inward taper, the inward or reverse taper was terminated a short distance above the tuyeres and the remaining bottom end portion of the body section given a cylindrical or outwardly tapered configuration, the breakout problem is substantially, if not entirely, eliminated.

It was further found in accordance with the present invention that by providing the cylindrical or outwardly tapered portion at the bottom end of the body section, together with the adjacent portion of the reverse taper portion, with a plurality of spaced interiorly projecting studs, further advantages could be obtained. Such studs were found to provide intensified localized cooling and simultaneously provide means for anchoring of initial refractory lining material as well as subsequent promotion of the formation of a layer of skulling material, thereby, providing protection against breakouts and increasing thermal efficiency of the cupola.

The invention and the above-mentioned advantages and improvements provided thereby will be further understood by those skilled in the art in the light of the following description thereof taken in connection with the accompanying drawings wherein.

Figures 1, 3:
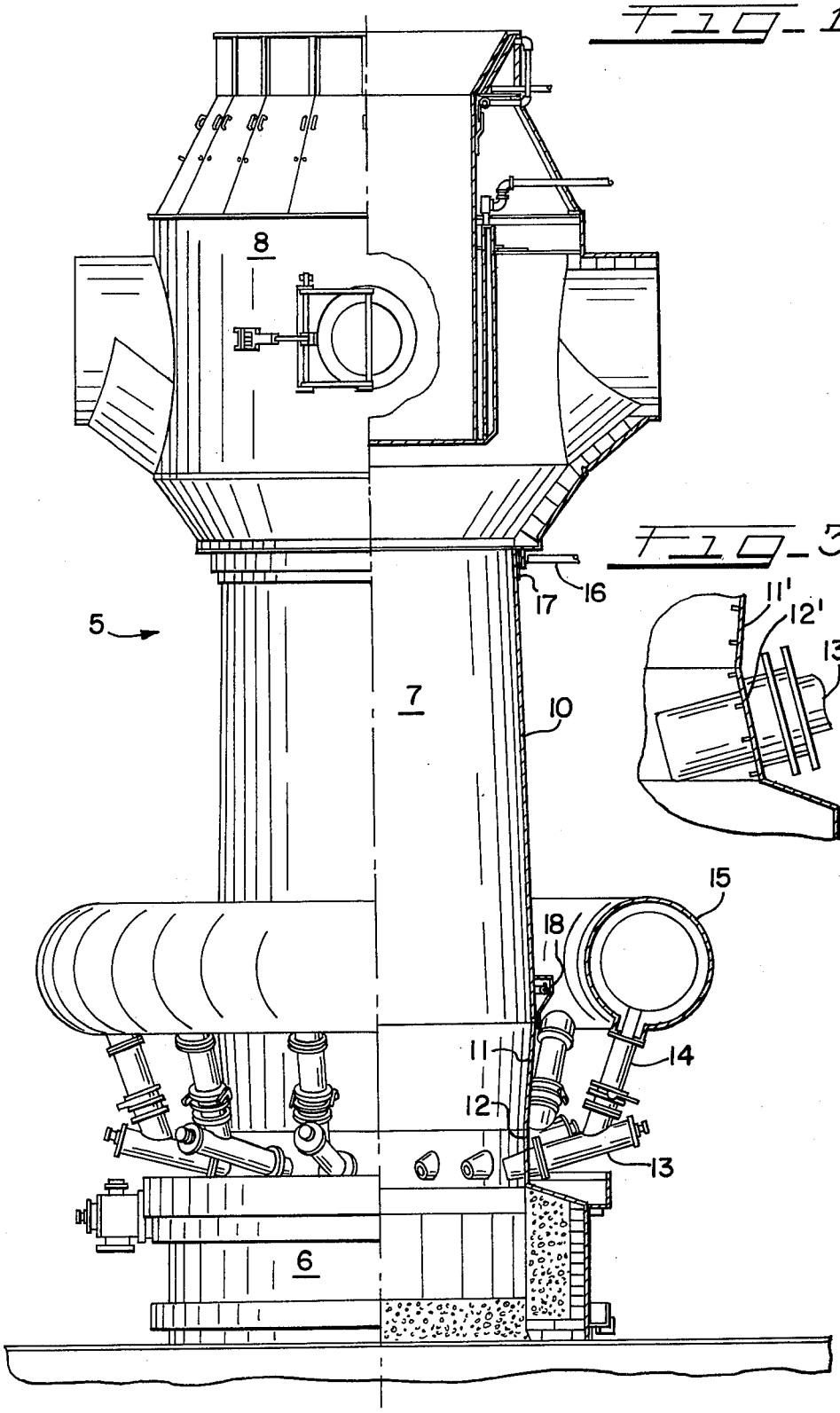
FIG. 1 is a view partly in elevation and partly in vertical section of a cupola in which an embodiment of the present invention is incorporated in the body section of the cupola.
FIG. 3 is a fragmentary view showing a modification.

The cupola indicated generally at 5 in FIG. 1 comprises the usual three primary sections, namely, the well section indicated generally at 6, the water-cooled body section indicated generally at 7 and the gas take-off section indicated generally at 8. It will be understood that the support foundation and associated gear for the bottom of the cupola 5 is not shown in FIG. 1. The cupola 5 is classified as a water-cooled, liningless cupola with a reverse taper and is suitable for production of various grades of molten gray or ductile base iron using such raw materials as steel scrap, scrap ferrous case materials, ferromananese, ferro silicon with coke, limestone and flurospar as non-metallic materials.

Since the structure and operation of water-cooled, liningless cupolas are well-known in the art, the following description will focus on the body section 7 and, especially, on the changes and departures from the prior are whereby the present invention is incorporated into the body section 7 and, thereby, the cupola 5.

The water-cooled body section 7 is divided into or composed of three distinct portions namely, the upper portion 10 which extends downwardly from the gas take-off section 8 and tapers outwardly in a downward direction, a reverse or inwardly tapered portion 11, the top of which joins the bottom end of the portion 10, and a cylindrical bottom end portion 12, the upper end of which joins the bottom end of the reverse or inwardly tapered portion 11. The cylindrical portion 12 is at the level which receives the tuyeres 13 which may be of conventional and known construction. The tuyeres 13 are water-cooled and project at a downward angle into the cylindrical portion 12. Air is delivered to each of the tuyeres 13 by a downcomer 14 connected in the usual manner with an internally-lined wind box 15.

Cooling water is supplied from a waterline 16 to an upper channel-type spray ring of known construction. The bottom of the spray ring opens into a downwardly extending neoprene skirt 17 which serves to evenly distribute the cooling water around the upper end of the body section 10. The cooling water flows downwardly on the outside of the portion 10 of the shell body 7 and is collected at the bottom of this portion in a water re-distribution ring 18 so that it is evenly re-distributed around the top of the reverse taper portion 11. Due to surface tension, the water flows down and it flows down the reverse taper portion 11. A neoprene skirt 20 fitting around the lower end of the redistribution ring 18 and projecting down and fitting around the upper end of the reverse taper portion 11 serves to evenly distribute the water at the top of this portion.

The reverse taper portion 11 and the cylindrical portion 12 of the water-cooled body section 7 embrace what is referred to as the "high heat area" of the cupola 5 when it is in normal operation. Prior to the present invention, the reverse taper portion 11 continued without a break to the top of the cupola well 6 and provided the advantages pointed out above. However, the reverse taper was also subject to the problem pointed out above resulting in an occasional breakout in the bottom end of the body section, particularly in-between the tuyeres. It was discovered in accordance with this invention that, by having the bottom end of the body section cylindrical, or outwardly tapered as indicated at 12' in FIG. 3, this problem could be alleviated or completely eliminated.

Figure 2:
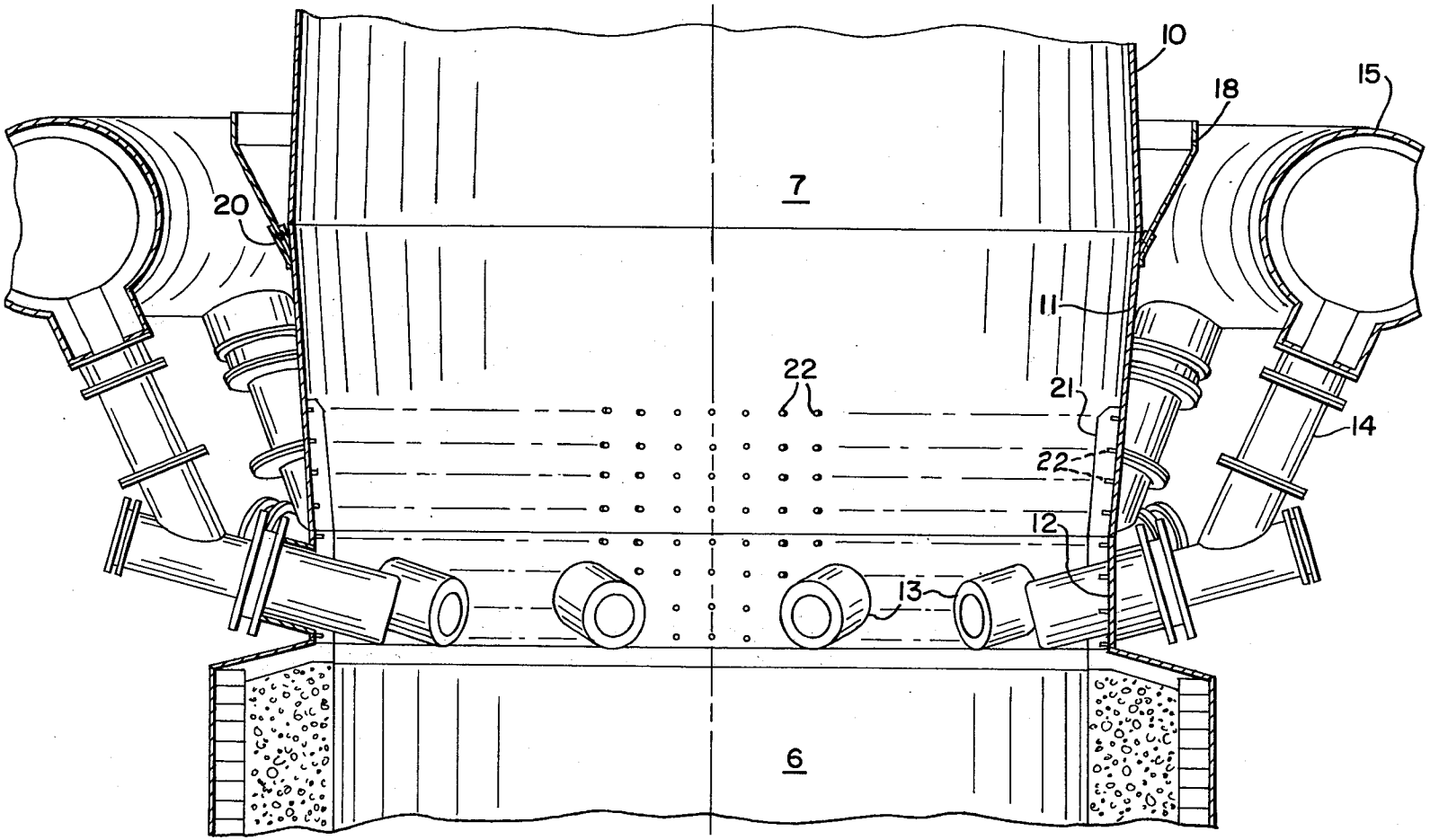
FIG. 2 is a fragmentary vertical section on enlarged scale of the reverse taper portion of the body section of the cupola in FIG. 1 wherein the present invention is incorporated.

It is conventional practice when putting a cupola such as cupola 5 back into operation after a shut-down to spray a lining of refractory insulation on the interior of the lower end of the water-cooled body section 7, such a lining being indicated in FIG. 2 at 21. During operation of the cupola, this lining 21 tends to gradually erode away. However, this reduction or loss is partially compensated for by the buildup of skull which takes the place of the insulation to an appreciable extent. It has been found, in accordance with this invention, that by providing the interior of the cylindrical portion 12 and an adjacent portion of the reverse taper 11 with a plurality of inwardly protruding or projecting studs 22—22, the sprayed-in insulation 21 will be much more firmly anchored in place so as to resist removal due to wear and abrasion in operation. Furthermore, the studs 22 also serve as anchors which promotes your retention of skull as it is formed. The studs serve to intensify localized cooling above the tuyeres, which promotes retention of refractory material and the subsequent formation of skulling material and thereby increasing the thermal efficiency of the cupola.

The studs preferably range in length from one-half to one and one-half inches, have diameters ranging from three-eighths to five-eighths inch diameter, and are spaced on five to six inch centers.

What is claimed as new is:

1. In a water-cooled, liningless cupola having a water-cooled liningless body section which extends downwardly from the bottom of the cupola gas take-off section to the top of the cupola well section, with the lower portion of said body section including the high heat area above the tuyeres tapering inwardly toward the bottom of the body section with respect to its vertical axis, the improvement which comprises having said inward taper terminate a short distance above the cupola tuyeres with the remaining bottom end portion of said body section being cylindrical or outwardly tapered.

2. In the improvement called for in claim 1, the portion of said body section which extends above said inwardly tapered lower portion being inwardly tapered in an upward direction with respect to its vertical axis.

3. In the improvement called for in claim 2, said portion of said body section which extends above said inwardly tapered lower portion comprising approximately two-thirds of the height of said body section.

4. In the improvement called for in claim 1, said remaining bottom end portion and an upper adjacent section of said inwardly tapered lower portion being provided with a plurality of interiorly projecting studs serving as anchoring means for refractory lining and skull.

5. In the improvement called for in claim 4, said studs having lengths of between about one-half inch to about one and one-half inches, diameters between about three-eighths inch to about five-eighths inch, and spaced on from about five inches to about six inches centers.

* * * * *